US007350512B1

(12) United States Patent
Meacham et al.

(10) Patent No.: US 7,350,512 B1
(45) Date of Patent: Apr. 1, 2008

(54) METHOD OF VALIDATING A DIAGNOSTIC PURGE VALVE LEAK DETECTION TEST

(75) Inventors: Daniel R. Meacham, Mendon, NY (US); Timothy K. Sheffer, Rush, NY (US); Mitchell G. Ober, Northville, MI (US); Kenneth M. Simpson, Swartz Creek, MI (US); Carol Galskoy, Webster, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/742,114

(22) Filed: Apr. 30, 2007

(51) Int. Cl.
*F02M 33/02* (2006.01)

(52) U.S. Cl. ..... 123/520; 123/516; 123/518; 123/519; 73/118.1; 73/49.7; 73/49.2

(58) Field of Classification Search ..... 123/520, 123/519, 518, 516; 73/118.1, 49.7, 49.2
See application file for complete search history.

(56) References Cited

U.S. PATENT DOCUMENTS 5,398,661 A * 3/1995 Denz et al. ..... 123/520
5,476,083 A * 12/1995 Blumenstock ..... 123/520
6,016,792 A * 1/2000 Kawano et al. ..... 123/520
6,227,037 B1 5/2001 Kawamura et al.
6,311,548 B1 11/2001 Breidenbach et al.
6,701,777 B2 * 3/2004 Yamaguchi et al. ..... 73/49.7
6,807,847 B2 10/2004 Steckler et al.
6,951,131 B2 10/2005 Sawert et al.
7,120,535 B2 10/2006 Rahman et al.
7,147,366 B2 12/2006 Melby et al.
7,203,617 B1 4/2007 Rahman et al.

OTHER PUBLICATIONS

SAE Technical Paper Series, 1999-01-0861, Development and Validation of a 0.020" Evaporative Leak Diagnostic System Utilizing Vacuum Decay Methods, Stephen F. Majkowski, Kenneth M. Simpson and Michael J. Steckler, Mar. 1999.

* cited by examiner

*Primary Examiner*—Stephen K. Cronin
*Assistant Examiner*—J. Page Hufty
(74) *Attorney, Agent, or Firm*—Paul L. Marshall

(57) ABSTRACT

A system and method for evaluating the integrity of a leak detection test for a purge valve of a fuel system in a vehicle reduces or eliminates false failures. The method is executed on an engine control module (ECM) and is configured to determine when vehicle soak conditions meet first criteria conducive to fuel vapor condensation in the fuel tank. The first criteria include a predetermined temperature drop in ambient air temperature between successive drive cycles. The ECM is further configured to determine when a vehicle maneuver meets second criteria indicative of the capability of the maneuver to initiate fuel slosh in the fuel tank, to thereby establish a trigger event. The ECM is further configured to determine, after the trigger event, the maximum slope of a fuel tank vacuum increase. The ECM is still further configured to produce a slope ratio as a function of the maximum vacuum increase slope and a reference vacuum slope corresponding to a slope that is unaffected by any slosh/condensation events. The ECM is configured to invalidate a purge leak test when the slope ratio exceeds a threshold.

14 Claims, 4 Drawing Sheets

METHOD OF VALIDATING A DIAGNOSTIC PURGE VALVE LEAK DETECTION TEST

TECHNICAL FIELD

The present invention relates generally to vehicle diagnostics and more particularly to a method of validating a diagnostic purge valve leak detection test.

BACKGROUND OF THE INVENTION

Increasing awareness of the effects of vehicle evaporative and exhaust emissions has resulted in regulations at both state and federal levels to control these emissions. In particular, on-board diagnostic regulations (e.g., OBDII) require that certain emission related systems on the vehicle be monitored, and that a vehicle operator be notified if the system is not functioning in a predetermined manner.

One example of an emission related system is a fuel system, which includes a fuel tank for storing fuel. Vapors from the fuel collect within the fuel tank. Occasionally, the fuel tank may develop a leak due to a hole, such as from a sharp object puncturing the fuel tank. Additionally, other components of the fuel system may develop leaks or otherwise begin to operate in a faulty manner. As a result, vapors present within the fuel system may inadvertently escape into the atmosphere. A primary component of the fuel vapor is hydrocarbon, which is known to have a detrimental effect on air quality. Currently, on-board diagnostic regulations require that a diagnostic small leak test and a very small leak test be performed periodically while the vehicle is operational, to detect a leak. As to the latter test, this diagnostic requires detection of leaks equivalent to an orifice of 0.50 mm diameter (0.020") to be detected. If a leak is detected by the diagnostic test, the vehicle operator is notified. For example, on-board diagnostics may be configured to perform a leak detection test on the fuel tank as seen by reference to U.S. Pat. No. 6,311,548 entitled "METHOD OF VALIDATING A DIAGNOSTIC LEAK DETECTION TEST FOR A FUEL TANK", issued to Breidenbach et al., assigned to the common assignee of the present invention. Breidenbach et al. disclose a fuel tank leak test in which a predetermined initial vacuum level is established in the fuel tank, and then the vacuum decay rate is monitored. A fuel tank leak would bleed the vacuum fairly quickly, failing the test. In the specific context of the fuel tank leak test, Breidenbach et al., also disclose that fuel slosh may affect the actual vacuum decay rate positively or negatively.

Additionally, it is known to run a diagnostic leak detection test on a purge control solenoid valve (PCSV). For this diagnostic, however, a decay in a vacuum level is not monitored. Rather, the purge control solenoid valve, which is coupled to the downstream or vacuum side of the throttle, is first closed. The diagnostic also calls for the closure of the vent valve, which as known is typically installed on the fresh air inlet of a charcoal canister. As further background, the vent valve, when open (normal operation), allows ambient air to enter the canister for use in replacing the purged vapor with the engine running. Further, when the engine is not running, as vapors are produced within the fuel system, they are collected by the charcoal canister, and then any remaining pressure is released through the vent. When the vent valve is closed (diagnostic operation), the vent allows the evaporative system to be closed off from the environment when the purge valve is additionally closed.

Then, as to the purge valve leak test, the fuel tank vacuum (pressure level) is monitored over time. If the vacuum increases beyond acceptance criteria, then the purge valve may be leaking. As to the purge valve leak detection test, one conventional leak detection approach may result in false failures. That is, this conventional diagnostic would indicate a failure of the purge flow leak test; however, subsequent testing shows the "failed" purge valve to be within leak specifications. This situation of falsely indicating that the purge leak test failed is undesirable, for example, resulting in increased cost (e.g., warranty claims) to inspect the system.

There is therefore a need for a method of evaluating the integrity of a purge valve leak detection test that minimizes or eliminates one or more of the problems set forth above.

SUMMARY OF THE INVENTION

One advantage of the present invention is that it provides for the reduction or elimination of false failures on a purge valve leak detection test. In this regard, it has been discovered that a combination of ambient vehicle soak conditions and a driving maneuver sufficient to create fuel "slosh" can create a false test failure. Fuel slosh or turbulence of the fuel within the fuel tank occurs when the vehicle undergoes a series of sudden movements. It has been discovered that if a vehicle is parked when ambient air temperature changes considerably while "soaking" and then the vehicle starts and then moves in a certain manner while the purge valve leak test is running, that a vacuum not due to any purge valve leak ("false vacuum") is generated in the fuel tank, which then appears to the diagnostic as a "leak". While this phenomenon is believed to be due to fuel vapor condensation due to the fuel slosh, when the fuel vapor has cooled to a lower temperature than the liquid fuel, it should be understood that the actual mechanism has not been verified, and its presence should not be implied as a requirement of the present invention. The present invention distinguishes between a real leak, which should be reported to the on-board diagnostics, and a false "slosh" induced failure, which should be ignored.

A method of evaluating the integrity of a leak detection test for a purge valve of a fuel system in a vehicle includes a number of steps. The first step involves determining when vehicle soak conditions meet first predetermined criteria conducive to fuel vapor phase changes in the fuel tank. In one embodiment, the first predetermined criteria includes satisfying a preselected temperature drop.

The next step involves determining when a vehicle maneuver meets second predetermined criteria indicative of the capability of the maneuver to initiate fuel slosh in the fuel tank thereby establishing a trigger event.

The next step involves determining, after the trigger event, a maximum slope of fuel tank vacuum increase. The maximum slope value is used to evaluate the effect of the slosh event on the vacuum level.

The next step involves producing a slope ratio as a function of the maximum vacuum increase slope (calculated in the previous step) and a reference vacuum slope. The reference vacuum slope is a parameter that is unaffected by the fuel slosh. In one embodiment, the reference vacuum slope is a pre-slosh event vacuum slope. In an alternative embodiment, the reference vacuum slope is a predetermined vacuum slope. Slosh induced false vacuum manifests itself by a relatively large increase over a short period of time. This is distinguishable from non fuel slosh induced vacuum increases. The slope ratio compares the post slosh event slope and the reference vacuum slope.

The final step involves invalidating the purge valve leak detection test when the slope ratio exceeds a predetermined threshold. In one embodiment, the invalidating step may involve discarding the test, or not counting the failure towards a fail count threshold where a diagnostic trouble code (DTC) would have to be set by the on-board diagnostics.

Other features and aspects of the invention are also presented.

BRIEF DESCRIPTION OF THE DRAWINGS

The present invention will now be described by way of example, with reference to the accompanying drawings.

DETAILED DESCRIPTION OF THE PREFERRED EMBODIMENT

Figure 1:
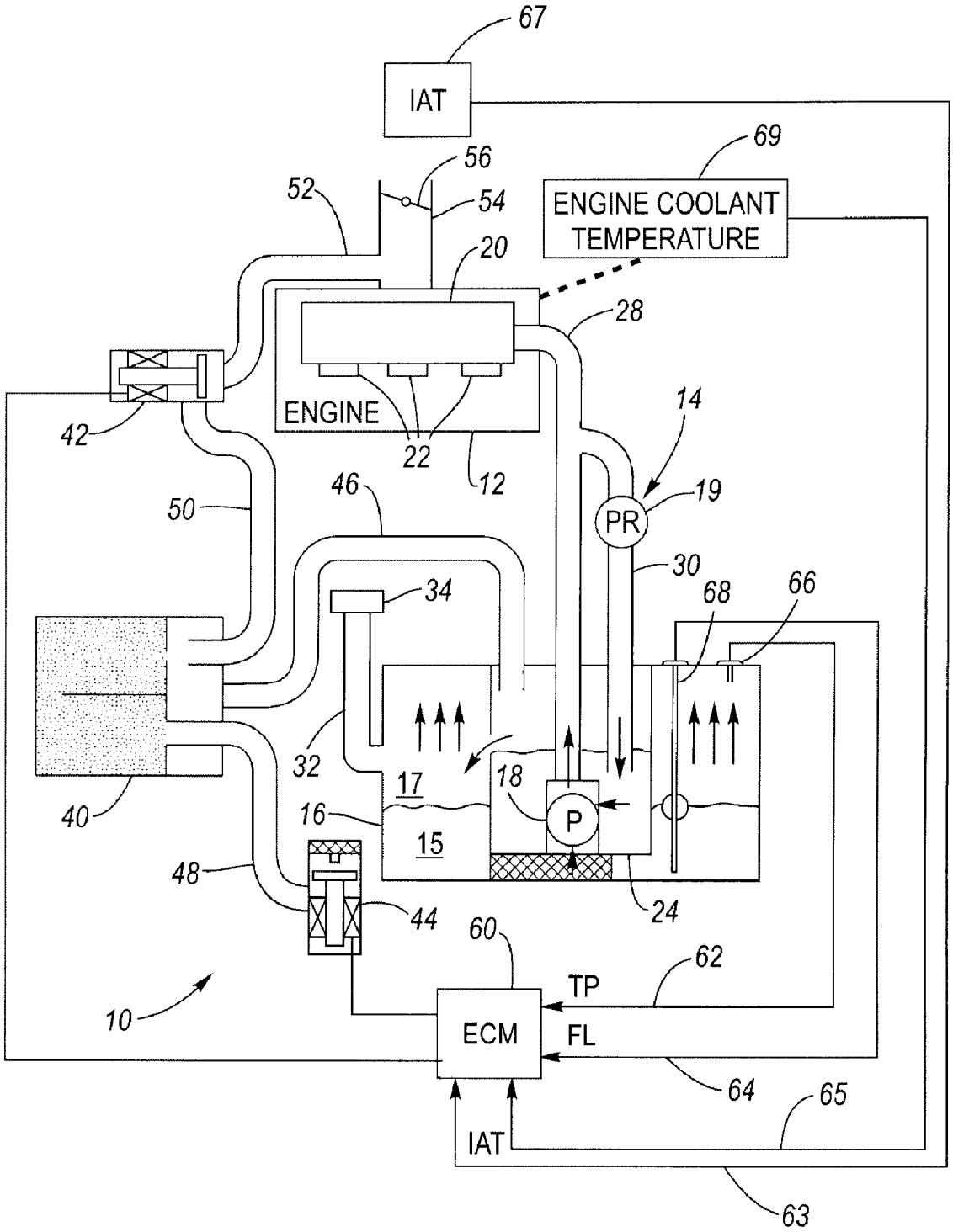
FIG. 1 is a diagram of an automotive evaporative emission system according to the invention, including a microprocessor-based engine control module (ECM).

Referring now to the drawings wherein like reference numerals are used to identify identical components in the various views, referring to FIG. 1, the reference numeral 10 generally designates an evaporative emission system for an automotive engine 12 and fuel system 14 including fuel 15 stored in a fuel tank 16. System 10 is suitable for use in an automotive vehicle (not shown).

Fuel tank 16 serves as a reservoir for holding a predetermined amount of liquid fuel 15 to be supplied to a power source such as engine 12. Fuel 15 may comprise conventional liquid fuels such as unleaded gasoline, for example only. It should be appreciated that the fuel system to be described is a closed system. The empty space within the fuel tank 16 is referred to as a vapor dome area 17 (sometimes vapor space area) and contains among other things fuel vapor. As fuel is draw out of fuel tank 16, the volume of fuel vapor within the vapor dome area increases.

With continued reference to FIG. 1, fuel system 14 further includes a fuel pump (P) 18, a pressure regulator (PR) 19, an engine fuel rail 20, and one or more fuel injectors 22. Fuel tank 16 has an internal chamber 24, and pump 18 draws fuel into chamber 24 through a filter 26, as generally indicated by the arrows. A fuel line 28 couples pump 18 to fuel rail 20, and pressure regulator 19 returns excess fuel to chamber 24 via a fuel line 30. Fuel is supplied to tank 16 via a conventional filler pipe 32 sealed by a removable fill cap 34.

The evaporative emission system 10 includes a charcoal canister 40, a purge control solenoid valve 42 ("PCSV") and an air vent solenoid valve 44. Canister 40 is coupled to fuel tank 16 via a line 46, to air vent valve 44 via a line 48, and to purge valve 42 via a line 50. The system 10 may further include a pressure relief valve (not shown), also known as a rollover valve, located in line 46 that operatively directs fuel vapor from fuel tank 16 into canister 40.

The air vent valve 44 is normally open so that canister 40 collects hydrocarbon vapor generated by the fuel in tank 16, and in subsequent engine operation, the normally closed purge valve 42 is modulated to draw the vapor out of canister 40 via lines 50 and 52 for ingestion in engine 12. To this end, line 52 couples purge valve 42 to an engine intake manifold 54 on the vacuum or downstream side of a throttle 56.

The air vent valve 44 and purge valve 42 are both controlled by a microprocessor-based engine control module (ECM) 60, based on a number of input signals, including without limitation a fuel tank pressure (TP) signal on line 62, an intake air temperature (IAT) signal on line 63, a fuel level (FL) signal on line 64, and an engine coolant temperature signal on line 65. The fuel tank pressure may be detected with a conventional pressure sensor 66, the intake air temperature may be detected with a conventional temperature sensor 67, the fuel level may be detected with a conventional fuel level sender 68, and the engine coolant temperature may be detected with a conventional engine coolant temperature sensor 69. Of course, ECM 60 controls a host of engine related functions, such as fuel injector opening and closing, ignition timing, and so on. ECM 60 is further configured to include memory, both volatile and non-volatile for storing software programs, data and other information, as known generally in the art.

In general, ECM 60 is configured to diagnose leaks in evaporative emission system 10 by suitably activating solenoid valves 42 and 44, and monitoring the fuel tank pressure TP. One conventional leak detection methodology is known as a purge valve leak detection test. In a purge valve leak test, both the PCSV 42 and the vent valve 44 are first commanded closed by ECM 60 and the pressure in the fuel tank TP is recorded. A leaking PCSV 42 will thereafter allow manifold vacuum to reach fuel tank 16 (i.e., evacuating vapor from tank 16, thereby increasing the vacuum level in the tank relative to atmospheric pressure). The resulting pressure/vacuum is sensed by tank pressure sensor 66 and is read by ECM 60. Based on predetermined criteria, ECM 60 can determine whether the PCSV 42 is leaking or not. However, as described in the Background, under certain conditions and when certain driving maneuvers are undertaken, vapor condensation can occur in the fuel tank 16 that can cause the fuel tank vacuum to increase markedly, thereby causing a false failure of the purge valve leak detection test described immediately above (i.e., this logic is looking for an increase in the vacuum level and the fuel vapor condensation provides it). The present invention is configured to detect, during the purge valve leak detection test, when the tank vacuum profile is being unduly confounded by such fuel vapor phase changes, which are initiated by bulk fuel movement in the fuel tank.

Figure 2:
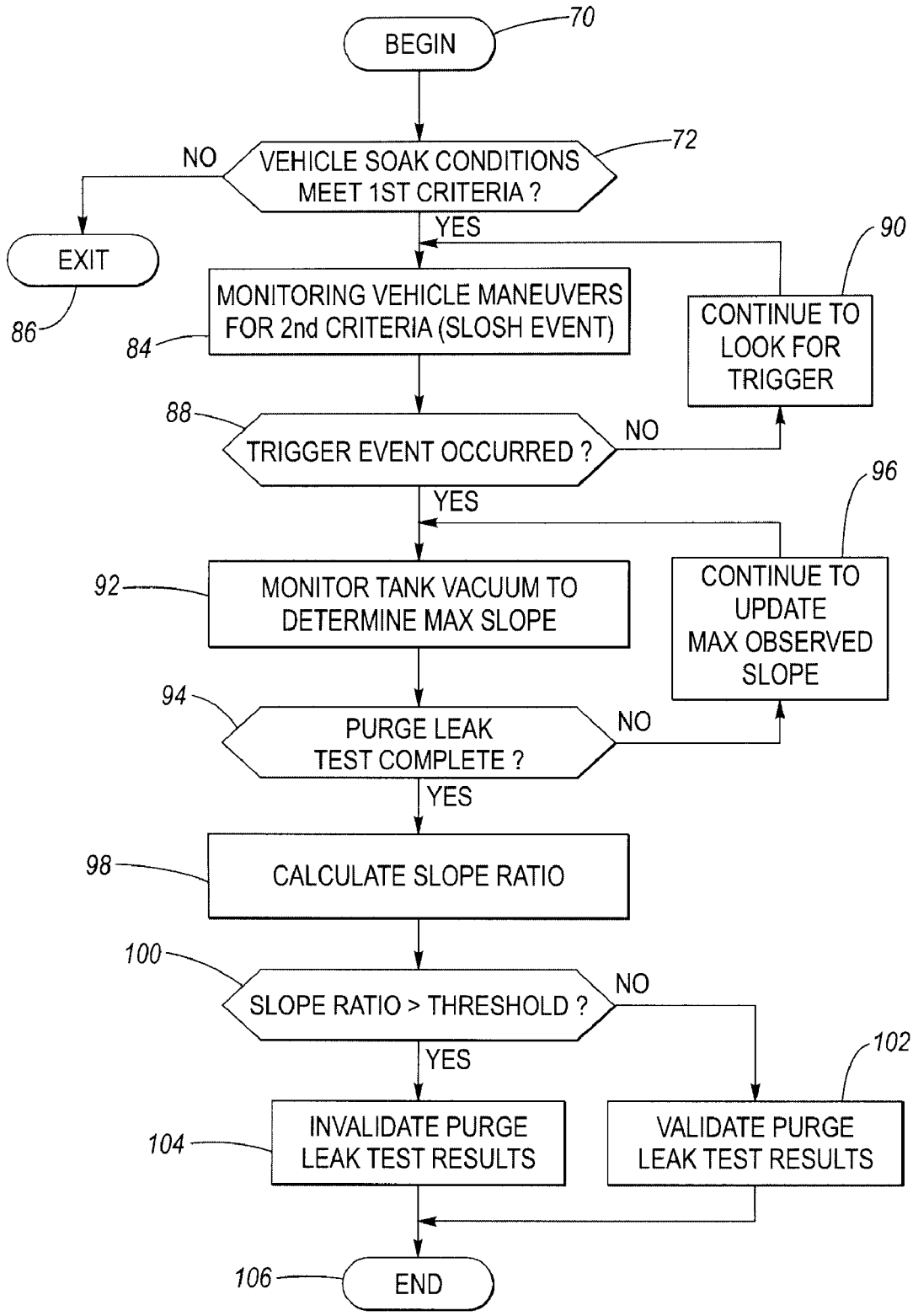
FIG. 2 is simplified flowchart showing the method of the present invention.

FIG. 2 is simplified flow chart illustrating the method of the present invention. The method begins in step 70. It should be understood that the functions, flow logic, decision points, and the like are, in a preferred embodiment, programmed into ECM 60 for execution. Moreover, it should be understood that the disclosure herein of such functionality, including flow charts, and the like, provide sufficient detail for one of ordinary skill in the art to practice the present invention. Execution by the programmed logic of the present invention, for example, begins immediately after a purge valve leak test has begun. The method proceeds to step 72.

In step 72, the method, by way of configuration of ECM 60, is configured to determine when vehicle soak conditions meet first predetermined criteria conducive to fuel vapor changes in the fuel tank. In one embodiment, the question presents itself as "HAS PARTIAL TANK COOLING OCCURRED?". To gain a better understanding of when vehicle soak conditions are conducive, and when they are NOT conducive, to fuel vapor changes, a more detailed description will now be set forth.

When partial tank cooling occurs, different portions of the fuel tank have cooled at different rates so as to result in a temperature differential between two or more of the portions. For example, such different portions of the fuel tank may includes a liquid fuel temperature, a fuel vapor temperature, and a fuel tank skin temperature. Consider the following examples.

EXAMPLE

Consider a vehicle that had been previously operated, during the prior cycle, under ambient temperature conditions of approximately 80° F. The vehicle is then turned off and allowed to "soak" (i.e., in an engine-off condition) for approximately four hours. During that soak time, the ambient temperature drops to approximately 50° F. Such conditions illustrate both a material ambient temperature drop and an insufficient time for the entire fuel tank to reach temperature equilibrium. During the next key-on cycle, there may be a 2° C. temperature differential between the liquid fuel temperature, the fuel vapor temperature and fuel tank skin temperature. This temperature differential is a product of the ambient temperature when the vehicle was turned off, how far the ambient temperature has fallen, and how long the vehicle has soaked (i.e., the vehicle soak conditions thus involve both temperature and time). When vehicle soak conditions are such that partial cooling of the fuel tank occurs, which causes such temperature differences between the fuel vapor and the liquid fuel below (and even with respect to the fuel tank skin), such vehicle soak conditions are suspect. When coupled with a vehicle maneuver (e.g., movement) that causes fuel slosh, such pre-existing conditions allow the fuel vapor to condense, which will drive an immediate vacuum increase, thereby failing the purge valve leak detection test.

Example

Consider a vehicle that has "soaked" overnight where the ambient temperature is a relatively constant 65° F. Note, the longer the soak time, the more time that the liquid fuel temperature, the fuel vapor temperature, and the fuel tank skin temperature all have to stabilize to more or less the same temperature (i.e., little temperature differences between them). Under such circumstances, the liquid-to-vapor temperature differential might only be a fraction of a degree C. Such vehicle soak conditions are NOT conducive to fuel vapor phase changes, and therefore, even when driving maneuvers occur that cause fuel slosh, phase change induced vacuum increases do not occur. Accordingly, the results of any purge valve leak detection test that is running will be based on the merits.

Returning to FIG. 2, decision block 72 is configured to determine when such conditions may have caused partial cooling in the fuel tank and thus significant temperature differences between the fuel vapor and the liquid fuel below it. In one embodiment, decision block 72 includes a number of substeps, described below, to ascertain when partial cooling may have occurred.

It should be understood that available temperature sensors can be used as a proxy for liquid fuel temperature measurements. In a constructed embodiment, Intake Air Temperature (IAT) is used. However, it should be understood that other temperature parameters may be used. For example, an ambient air temperature sensor (not shown in FIG. 1), a fuel tank vapor space temperature sensor (not shown in FIG. 1) or, preferably, a fuel tank liquid temperature sensor (not shown in FIG. 1) may all be used as an alternative to the Intake Air Temperature.

The present invention, while programmed in ECM 60 to operate for each key cycle, is particularly configured to compare ambient air temperatures as a proxy for liquid fuel temperature (most preferred) from successive cycles. Herein, these cycles will be referred to as a first cycle and a second cycle, although it should be understood that the logic performed is more in the nature of a sliding window, evaluating adjacent data from successive cycles. For clarity, a key-on, engine-run, and key-off may constitute a complete cycle.

During a first cycle, a minimum ambient air temperature value is determined. In this regard, in the absence of a liquid fuel temperature sensor, the Intake Air Temperature (IAT) is used during engine running situations. Of course, for situations that are equipped with a dedicated, separate, liquid fuel temperature sensor or ambient air temperature sensor, such sensor would preferably be used for determining the minimum liquid fuel temperature in lieu of using the IAT sensor as a proxy for liquid fuel temperature or ambient air temperature.

The values for IAT are monitored by ECM 60 and the minimum value thereof is identified, and is stored in non-volatile memory associated with ECM 60 for use on the next key cycle. This is known as the minimum ambient air temperature parameter. While the foregoing is the general rule, the method of the present invention is configured to include an exception for short engine-run times. Specifically, the method will update the minimum ambient temperature parameter with the minimum IAT for the then-ended cycle only when the engine-run time is greater than a preselected minimum time. This exception is configured to shield the inventive method from short engine operation events where underhood temperature settling could cause the IAT to misrepresent ambient conditions (i.e., the IAT being artificially high). It should be understood, based on the above description, that other sensor types may be used (as described above). In any event, despite the variety of possible permutations recognized by one of ordinary skill in the art, this first substep of decision block 72 results in a minimum ambient air temperature parameter being saved in non-volatile memory for used on the next key cycle. Since the updating described above occurs at the end of a cycle, the vehicle is now off and is "soaking".

Upon the next subsequent ECM 60 key-on (the second cycle), the method is configured to compare the stored minimum ambient air temperature parameter from the immediately preceding cycle (i.e., the first cycle) described above, and, the lower of (i) the start-up intake air temperature for the current key cycle and (ii) start-up coolant temperature value for the current key cycle. This substep is to determine whether the ambient air temperature has dropped during the vehicle soak period. In a constructed embodiment, first predetermined criteria (block 72) includes a predetermined temperature drop (i.e., of the liquid fuel temperature). The predetermined temperature drop of liquid fuel temperature may range between as low as 4° C. to 5° C. It should be understood that in a constructed embodiment, a liquid fuel temperature sensor was not used, but rather an intake air temperature. Due to the variability in the values of an intake air temperature to reflect any one of the ambient air temperature, fuel tank vapor space temperature, or liquid fuel temperature, in the constructed, the predetermined temperature drop accommodates IAT increases on the subsequent cycle provided it does not exceed 15° C. However, it should be understood that a predetermined temperature drop in the liquid fuel temperature is what provides the conditions conducive to fuel vapor condensation.

Optionally, decision block 72 may include the further substep to evaluate the duration of the soak time. Recall, given sufficiently long soak times, the liquid fuel and the fuel vapor will have reached equilibrium and thus have only a very small, if any, difference in temperature. Accordingly, the engine-off time (soak time) is evaluated to determine if the vehicle soak has been short enough to still exhibit partial cooling in the fuel tank. It should be understood that this substep is optional, inasmuch as in some scenarios, the vehicle may be susceptible to fuel slosh induced fuel vapor changes regardless of the soak time. In such circumstances, the soak time criteria may be selected in a manner that would effectively eliminate it from the other conditions described above.

In sum, when the ambient temperature has dropped so as to satisfy the predetermined temperature drop, and when, optionally, a soak time parameter is no greater than a predetermined maximum soak time, then the vehicle soak conditions are conducive to slosh induced vapor phase changes. The first predetermined criteria have been met, and the method branches from step 72 and proceeds to step 84. However, if these criteria are not met, then the method branches from step 72 and proceeds to step 86 ("EXIT").

In step 84, the method determines when a vehicle maneuver meets second predetermined criteria indicative of the capability of the maneuver to initiate fuel slosh in the fuel tank thereby establishing a trigger event. In one embodiment, step 84 performs the function of monitoring vehicle speed, or, in an alternate embodiment, monitoring an acceleration and/or deceleration of the vehicle. The method then proceeds to decision block 88.

In decision block 88, the method determines whether the monitored speed or acceleration, as the case may be, meets the second predetermined criteria, to establish the trigger event. Depending on the fuel tank configuration, fuel tank material, exhaust system location, chassis mechanization, and the like, one of the following two tests, if met, will result in the second predetermined criteria being met.

In the first test, the method establishes the trigger event when the monitored vehicle speed exceeds a first speed threshold. In an alternate embodiment, the method establishes the trigger event when the monitored vehicle acceleration exceeds an acceleration threshold. Acceleration rate is preferred but requires sufficient processing power available in ECM 60 to calculate it. In one embodiment, the first speed threshold may be approximately 2 kilometers per hour, and the first acceleration threshold may be approximately 2.8 meters/sec$^2$. As described above, these values may vary depending upon a variety of factors (e.g., tank configuration, etc. all as described above).

In the second test, the method establishes the trigger event when the monitored speed exceeds a first speed threshold, and thereafter, when the monitored speed declines to below a second speed threshold that is lower than the first speed threshold. In an alternate embodiment, the method establishes the trigger event when a monitored acceleration rate exceeds an acceleration threshold, and thereafter, a monitored acceleration rate of the vehicle exceeds a deceleration threshold. The acceleration/deceleration embodiment is preferred but requires sufficient processing power available in ECM 60 to calculate it and make such determinations. In one embodiment, the first speed threshold and second speed threshold (for the second test) may be 5 kilometers per hour and 2 kilometers per hour, respectively. The first acceleration threshold and the first deceleration threshold may be 2.8 meters/sec$^2$ and 1.4 meters/sec$^2$ (i.e., corresponding to an acceleration rate of −1.4 m/s$^2$), respectively.

With either the first or second tests for the trigger event, the method may further involve requiring multiple occurrences of either the first test (one threshold) or second test (dual thresholds) in order to establish the trigger event. If no trigger event has been detected in decision block 88 (i.e., no vehicle maneuvers sufficient to cause a fuel slosh), then the method branches to step 90 ("Continue to look for a trigger event"), which then flows back to step 84. However, if decision block 88 detects a trigger event, then the method branches to step 92.

In step 92, the method determines, after the trigger event, a maximum slope of fuel tank vacuum increase. Step 92 involves monitoring the fuel tank vacuum (pressure) level and looking for a maximum slope. As described above, the phenomenon of the fuel vapor phase change (i.e., condensation) results in a rapid increase in vacuum in the vapor dome portion 17 of fuel tank 16. This rapid change is far different than would be expected for a properly operating purge valve 42 or even a leaking purge valve 42. The maximum rate of vacuum increase essentially is defined, in one embodiment, as the maximum slope. The time period over which the maximum slope is determined may be set by a predetermined slope time period. Negative slopes are preferably considered zero. The maximum slope is then logged. The maximum slope is used in a subsequent step to determine whether the fuel slosh had a significant effect on the purge valve leak detection test. The method then proceeds to decision block 94.

In decision block 94, the method determines whether the purge valve leak detection test has been completed. The method of the present invention, after a trigger event, will continue to monitor for a maximum slope in vacuum increase for the duration of the purge leak test. Accordingly, if the answer is "NO", then the method branches to step 96 ("Continue to update the maximum observed slope"), which then flows back into step 92. Otherwise, if the purge leak test has been completed, the answer is "YES" and the method branches to step 98.

Step 98 and decision block 100 in combination determine the effect, if any, of the fuel slosh event/phase change on the purge valve leak test.

In step 98, the method produces a slope ratio as a function of the maximum vacuum increase slope (described above in steps 92, 94 and 96) and a reference vacuum slope. Thus, at the end of the purge leak test, if a slosh event (trigger event) was detected, the maximum post-slosh vacuum slope is compared to a reference vacuum slope-one that is unaffected by the slosh effects. This unaffected slope value can be either the observed slope of the tank vacuum prior to the slosh event, or, a predetermined nominal vacuum slope value. As to the latter, the predetermined nominal vacuum slope value is preferably determined as a function of the fuel tank vapor space or fuel fill level (i.e., as a proxy for vapor space and the vapor space surface area). The principle is that as the vapor space decreases, any vacuum increases, for example, due to a leaky purge valve, will have a greater effect on the overall vapor dome vacuum level, all other things being equal. In a preferred embodiment, the slope ratio is calculated by dividing the post-slosh event maximum vacuum slope by the unaffected slope (either pre-slosh or predetermined nominal slope value). The use of the pre-slosh event slope is preferred, but requires greater computing resources that must be available in ECM 60 to implement. The method then proceeds to step 100.

In step 100, the produced slope ratio is compared to a predetermined threshold value. In one embodiment, where the time period was approximately 2 seconds for calculating the post slosh slope, the predetermined threshold values ranged between about 2 to 2.5. As with the other parameters described herein, there may be variation based on factors such as sampling time period, fuel system configuration, etc. When the slope ratio is less than the predetermined threshold, then the purge leak test is considered to be unaffected by the fuel slosh. In this instance, the method branches to step 102. In step 102, the results of the purge leak test are validated, at least insofar as the integrity check in accordance with the invention is concerned. The purge valve leak test may report its test results to some other on-board diagnostic control program.

However, when the slope ratio is greater than the predetermined threshold, then the purge leak test results are considered to have been corrupted by the fuel slosh. In this instance, the method branches to step 104. In step 104, the results of the purge leak test are invalidated. In one embodiment, "invalidated purge leak test results" means that the test results are discarded, ignored, and/or not reported to another on-board diagnostic control program. For example only, certain non-continuous monitoring diagnostics (e.g., evaporative emission monitoring) require that such diagnostic fail twice before a diagnostic trouble code (DTC) is set and a malfunction indicator lamp (MIL) is illuminated. Under the present invention, the false failure of the purge leak test, now detected by the present invention, is not countable towards the required two consecutive failed tests for purposes of setting a DTC and illuminating the MIL. Other responses are possible, and known to those of ordinary skill in the art.

The method ends in step 106.

Figure 3:
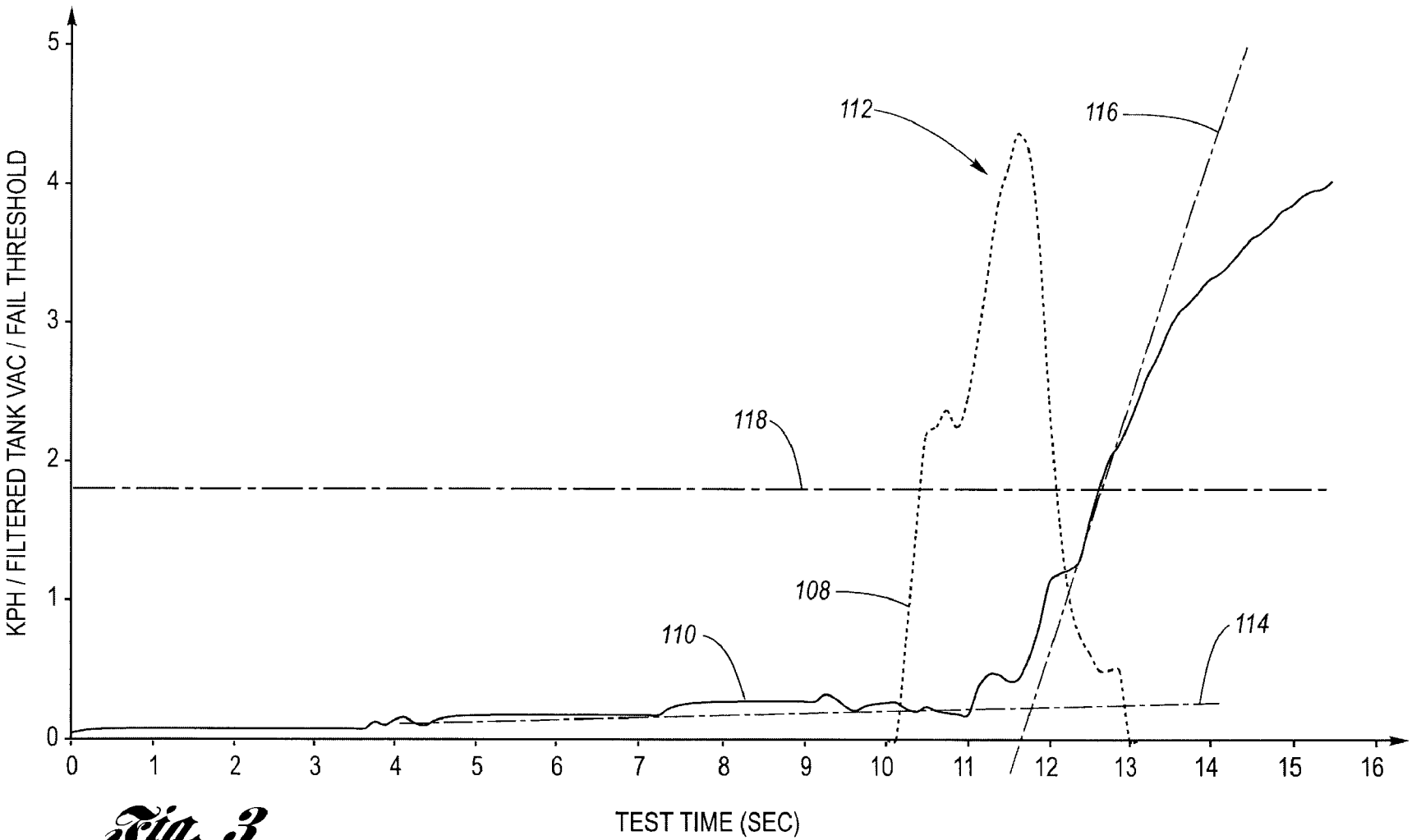
FIG. 3 is a first combination timing diagram illustrating a single fuel slosh event causing a false vacuum.

FIG. 3 is a combination timing diagram showing a variety of parameters for a single slosh "false failure" that is detected in accordance with the invention. FIG. 3 shows a vehicle speed trace 108, a fuel tank vacuum level trace 110, a driving maneuver 112 satisfying the criteria for a trigger/slosh event, a pre-slosh event vacuum slope 114, a post-slosh event maximum vacuum slope 116, and a predetermined threshold 118. It should be understood that the illustrated slope lines 114 and 116 assume a predetermined time period over which such slope is calculated, and that varying such time period can change the actual slope these lines assume. In other words, FIG. 3 is exemplary only and not limiting in nature.

In FIG. 3, the vehicle soak conditions satisfy the first predetermined criteria described above (i.e., in this example, the 4 hour evening cool down from approximately 80° F. to 50° F. would satisfy the first predetermined criteria described above). The vehicle movements, in terms of an increase in speed beyond a first speed threshold and a subsequent decrease in speed below a second speed threshold are also satisfied for purposes of this FIG. 3 (note the trigger/slosh event 112). Further note that the pre-slosh event vacuum increase slope 114 is very gentle, nearly zero (horizontal) in value. This is characteristic of a non-slosh slope, even with a leaky purge valve. Note, however, the dramatic post-slosh event maximum slope 116 in vacuum level increase. While some variation may be obtained depending on the interval over which the slope is calculated, it should be understood that such maximum slope is readily distinguishable compared to pre-slosh event slope. When the slope ratio is taken, the numerical value provides a parameter that allows the present invention to detect fuel vapor changes. Trace 118 illustrates the threshold for a vacuum level increase in the fuel tank to "fail" the purge leak test. In the illustrative case, the fuel vapor phase change resulted in sufficient vacuum level increase in the fuel vapor dome to have failed the purge valve leak test. This may not always be true. The present invention is looking for a maximum slope in the vacuum level increase, not an absolute vacuum level, to detect this fuel vapor condensation, and then indicating that the purge leak test may be corrupted thereby, and invalidate the results.

Figure 4:
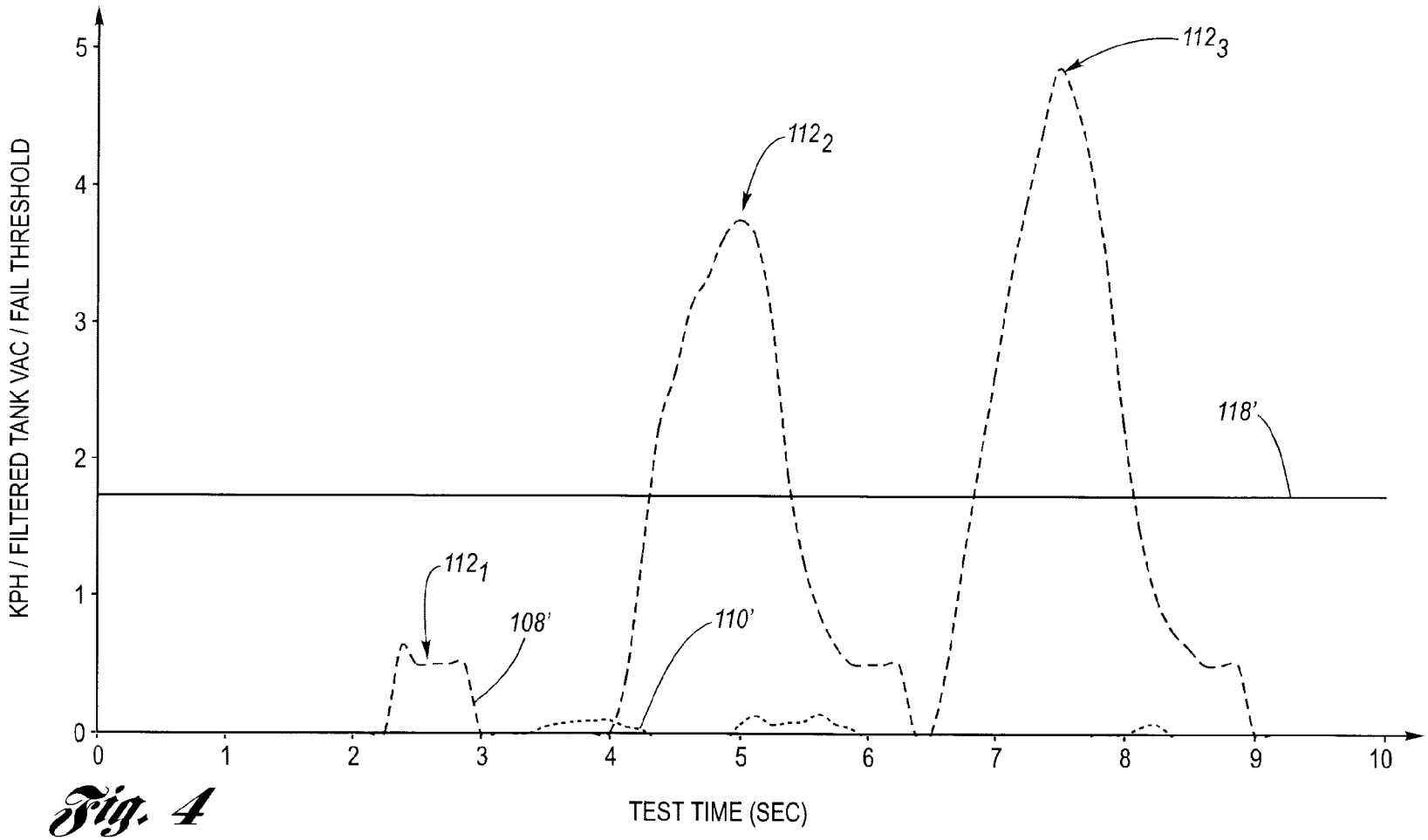
FIG. 4 is a second combination timing diagram illustrating a multiple fuel slosh event episode that did not result in generation of a false vacuum.

FIG. 4, on the other hand, illustrates the results when conditions are not conducive to slosh-induced fuel vapor phase change. The setup for FIG. 4 involves a lengthy, stabilizing overnight vehicle "soak". The same parameters as in FIG. 3 are also traced out in FIG. 4, namely, vehicle speed in trace 108', fuel tank vacuum level in trace 110', and multiple slosh events $\mathbf{112}_1$, $\mathbf{112}_2$ and $\mathbf{112}_3$. As can be seen, despite the multiple fuel sloshes, no significant, "steep" increases in vacuum level are observed in vacuum level trace 110'. This is principally due to the fact that the vehicle soak conditions were such that any partial cooling in the fuel tank (i.e., temperature differences between the liquid fuel and the fuel vapor) were allowed to stabilize before any fuel slosh events occurred.

The present invention presents a new and non-obvious system and method configured to enhance the ability of an on-board diagnostic routine to detect and reject test results that have been corrupted by fuel vapor condensation, on the principle that such results are a false failure of the purge valve leak test (i.e., the purge valve leak test conducted cannot be relied upon to indicate whether the purge valve is leaky or not).

While particular embodiments of the invention have been shown and described, numerous variations and alternate embodiments will occur to those skilled in the art. Accordingly, it is intended that the invention be limited only in terms of the appended claims.

The invention claimed is:

1. A method of evaluating the integrity of a leak detection test for a purge valve of a fuel system in a vehicle, said method comprising the steps of:

determining when vehicle soak conditions meet first predetermined criteria conducive to fuel vapor phase changes in the fuel tank;

determining when a vehicle maneuver meets second predetermined criteria indicative of the capability of the maneuver to initiate fuel slosh in the fuel tank thereby establishing a trigger event;

determining, after the trigger event, a maximum slope of fuel tank vacuum increase;

producing a slope ratio as a function of the maximum vacuum increase slope and a reference vacuum slope;

invalidating the purge valve leak detection test when the slope ratio exceeds a predetermined threshold.

2. The method of claim 1 wherein the first predetermined criteria includes a predetermined temperature drop, said step of determining when vehicle soak conditions meet first predetermined criteria includes the substeps of:

determining a first temperature parameter indicative of a minimum liquid fuel temperature during a first cycle;

determining a second temperature parameter indicative of a current liquid fuel temperature at the beginning of a second cycle subsequent to the first cycle;

calculating a difference between the first and second temperature parameters;

determining whether the calculated difference exceeds the predetermined temperature drop.

3. The method of claim 2 wherein said first temperature parameter determining step includes the substep of:

selecting a proxy from the group comprising an ambient air temperature, an intake air temperature (IAT), a fuel tank vapor space temperature, and a fuel tank liquid temperature;

monitoring, during the first cycle, a value of the proxy and determining the minimum value thereof;

assigning the determined minimum value of the proxy to the first temperature parameter.

4. The method of claim 3 wherein the proxy comprises the IAT.

5. The method of claim 3 wherein said assigning step is performed when a duration of an engine-run portion of the first cycle exceeds a predetermined minimum time period.

6. The method of claim 1 further comprising the step of determining an ambient soak time between an end of a first cycle and a beginning of a second cycle, wherein said step of determining when vehicle soak conditions meet first predetermined criteria includes the substeps of:

comparing the ambient soak time and a preselected maximum time period;

determining that the first predetermined criteria are not met when the ambient soak time is greater than the preselected maximum time period.

7. The method of claim 2 wherein said step of determining the second temperature parameter includes the substeps of:

measuring a start-up intake air temperature (IAT) value for the second cycle;

measuring a start-up engine coolant temperature value for the second cycle;

selecting the second temperature parameter from the lower of the start-up IAT value and the start-up engine coolant temperature value at the beginning of the second cycle.

8. The method of claim 1 wherein said step of determining when a vehicle maneuver meets second predetermined criteria includes the substeps of:

measuring a vehicle speed;

establishing the trigger event when the vehicle speed exceeds a speed threshold.

9. The method of claim 1 wherein said step of determining when a vehicle maneuver meets second predetermined criteria includes the substeps of:

measuring a vehicle acceleration;

establishing the trigger event when the vehicle acceleration exceeds an acceleration threshold.

10. The method of claim 1 wherein said step of determining when a vehicle maneuver meets second predetermined criteria includes the substeps of:

measuring a vehicle speed and determining when the speed exceeds a first speed threshold and thereafter determining when the speed declines to below a second speed threshold to thereby establish the trigger event.

11. The method of claim 1 wherein said step of determining when a vehicle maneuver meets second predetermined criteria includes the substeps of:

measuring a vehicle acceleration rate and determining when the acceleration rate exceeds an acceleration threshold;

after said acceleration measuring step, measuring a vehicle deceleration rate and determining when the deceleration exceeds a deceleration threshold to thereby establish the trigger event.

12. The method of claim 1 wherein said step of determining the maximum vacuum increase slope includes the substeps of:

monitoring a vacuum level in the vapor space of the fuel tank after the trigger event and for a remainder of the purge valve leak detection test;

calculating a plurality of slope values for the monitored vacuum level each taken over a respective preselected time interval; and determining one slope value of the plurality of slope values that has the largest value.

13. The method of claim 1 wherein said step of producing a slope ratio as a function of the maximum vacuum increase slope and a reference vacuum slope includes the substeps of:

selecting the reference vacuum slope from the group comprising (i) a pre-slosh event vacuum level slope and (ii) a predetermined vacuum slope calculated at least as a function of a fuel tank vapor space or fuel fill level; and dividing the maximum vacuum increase slope by the reference vacuum slope.

14. The method of claim 1 wherein the step of invalidating the purge valve leak detection test when the slope ratio exceeds a predetermined threshold includes the substep of:

discarding the results of the purge valve leak detection test.

* * * * *